US011700487B2

(12) United States Patent
Liang et al.

(10) Patent No.: US 11,700,487 B2
(45) Date of Patent: Jul. 11, 2023

(54) SPEAKER DEVICE

(71) Applicant: AAC Microtech (Changzhou) Co., Ltd., Changzhou (CN)

(72) Inventors: Ping Liang, Shenzhen (CN); Bin Zhao, Shenzhen (CN); Wei Song, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 0 days.

(21) Appl. No.: 17/542,522

(22) Filed: Dec. 6, 2021

(65) Prior Publication Data

US 2022/0191618 A1 Jun. 16, 2022

(30) Foreign Application Priority Data

Dec. 16, 2020 (CN) ..... 202023045212.1

(51) Int. Cl.
*H04R 9/02* (2006.01)

(52) U.S. Cl.
CPC ..... *H04R 9/025* (2013.01)

(58) Field of Classification Search
CPC ..... H04R 9/025; H04R 9/06; H04R 2400/11; H04R 9/043; H04R 9/045; H04R 7/04; H04R 7/18; H04R 7/20; H04R 2499/11; H04R 7/16
See application file for complete search history.

(56) References Cited

FOREIGN PATENT DOCUMENTS

| | | | | |
|---|---|---|---|---|
| CN | 109831723 A | * | 5/2019 | |
| CN | 109889964 A | * | 6/2019 | ..... F04B 35/04 |
| CN | 209201338 U | * | 8/2019 | |

* cited by examiner

*Primary Examiner* — Angelica M McKinney
(74) *Attorney, Agent, or Firm* — W&G Law Group

(57) ABSTRACT

The present disclosure provides speaker device. speaker device includes frame, vibration unit fixed to frame and magnetic circuit unit fixed to the frame and driving vibration unit to vibrate and produce sound, where magnetic circuit unit is provided with magnetic gap; vibration unit includes diaphragm fixed to frame, holder fixed to diaphragm; holder includes bottom wall that is fixed to diaphragm and provided with pair of long edges and pair of short edges, and pair of side walls bending and extending from outer peripheries of pair of short edges of bottom wall to magnetic circuit unit; The disclosure effectively solves problem of material underflow during molding of diaphragm of speaker device. In this way, connection parts between side walls and elastic conductive assembly are prevented from being contaminated, thereby reducing risk of unstable gluing between side walls and elastic conductive assembly.

6 Claims, 8 Drawing Sheets

A–A

B–B

SPEAKER DEVICE

TECHNICAL FIELD

The present disclosure relates to the field of electro-acoustic conversion, in particular to a speaker device.

BACKGROUND

With the advent of the Internet era, the number of mobile terminal devices continues to rise. Mobile phones are undoubtedly the most common and most portable mobile terminal devices. Speaker devices are widely used in mobile terminal devices such as mobile phones for playing music, etc. The vibration unit is an important part of the speaker device, which enables the entire speaker device to vibrate and produce sound.

In the related art, a speaker device includes a frame, a vibration unit fixed to the frame and a magnetic circuit unit driving the vibration unit to vibrate and produce sound. The vibration unit includes a diaphragm, a voice coil inserted into a magnetic gap to drive the diaphragm to vibrate, a holder connected to the diaphragm and supporting and suspending the voice coil under the diaphragm and an elastic conductive assembly connected to a side of the holder away from the diaphragm. The voice coil includes a lead wire electrically connected to the elastic conductive assembly. The magnetic circuit unit includes a yoke and a magnet fixed to the yoke. The magnet includes a main magnet and an auxiliary magnet forming the magnetic gap with the main magnet.

In the related art, the holder includes a bottom wall and a side wall bending and extending from the bottom wall to the magnetic circuit unit. During the molding process of the diaphragm, the material of the diaphragm will underflow to contaminate the connection part between the holder and the elastic conductive assembly, resulting in unstable gluing between the holder and the elastic conductive assembly.

Therefore, it is necessary to provide a speaker device to solve the above problem.

SUMMARY

An objective of the present disclosure is to provide a speaker device, which effectively solves the problem of material underflow during the molding of a diaphragm.

In order to achieve the above objective, the present disclosure provides a speaker device. The speaker device includes a frame, a vibration unit fixed to the frame and a magnetic circuit unit fixed to the frame and driving the vibration unit to vibrate and produce sound, where the magnetic circuit unit is provided with a magnetic gap; the vibration unit includes a diaphragm fixed to the frame, a holder fixed to the diaphragm and a voice coil inserted into the magnetic gap and connected to the holder; the holder includes a bottom wall that is fixed to the diaphragm and comprises a pair of long edges and a pair of short edges each bending and extending from an outer periphery of a respective one of the pair of short edges of the bottom wall to the magnetic circuit unit; each of the pair of side walls is provided with an opening portion on a side close to one of the pair of long edges; the opening portions is provided with a first through holes; and the diaphragm is connected to the opening portions and partially accommodated in the first through holes.

As an improvement, the bottom wall may be ring-shaped; the holder may further include a connecting portion bending and extending from an inner periphery of the bottom wall toward the magnetic circuit unit; and the voice coil may be fixed to and connected to the connecting portion.

As an improvement, the diaphragm may include a vibrating portion provided with a second through hole, a suspension portion extending from an outer periphery of the vibrating portion and surrounding the vibrating portion, a fixing portion bending and extending from a side of the suspension portion away from the vibrating portion and fixed to the frame, and a dome located in the second through hole; and the bottom wall connects the vibrating portion and the dome.

As an improvement, the vibrating portion may further include a gluing member that may be provided at a position corresponding to the opening portions and bends and extends toward the magnetic circuit unit; the gluing members may be provided with a fixing post that may be located at a position corresponding to the first through holes and extend inward the first through hole; the gluing member may be fixed to and connected to the opening portions; and the fixing posts may be accommodated in the first through holes.

As an improvement, the vibration unit may further include an elastic conductive assembly fixed to the frame and an end of the holder away from the diaphragm; the elastic conductive assembly each includes an elastic conductive body connected to the frame and an end of one of the pair of side walls away from the diaphragm, a connecting arm bending and extending from the elastic conductive body toward the voice coil along one of the pair of side walls and a pad connected to the connecting arm; and the pad may be fixed to and connected to a side of the bottom wall away from the diaphragm.

As an improvement, the connecting arm may include a first bending portion bending and extending from the elastic conductive body toward the bottom wall and a second bending portion bending and extending from the first bending portion toward the voice coil; the first bending portion and one of the pair of the side walls may be spaced apart in parallel; and the second bending portion and the pad may be respectively connected to a side of the bottom wall away from the diaphragm.

As an improvement, the magnetic circuit unit may include a yoke, a main magnet fixed to the yoke, a peripheral magnet surrounding the main magnet and spaced apart from the main magnet to form the magnetic gap, a first magnetic conductor fixed to and covering the main magnet and a second magnetic conductor fixed to and covering the peripheral magnet; the second magnetic conductor may be fixed to and connected to a side of the frame away from the diaphragm; and the second magnetic conductor may be provided with an avoiding portion at a position corresponding to the pad.

Compared with the related art, in the present disclosure, the ends of the side walls of the holder are provided with opening portions, and the opening portions are provided with first through holes. During the molding of the diaphragm, the material flows into the first through holes along the opening portions. This design effectively solves the problem of material underflow during the molding of the diaphragm of the speaker device. In this way, the connection parts between the side walls and the elastic conductive assembly are prevented from being contaminated, thereby reducing the risk of unstable gluing between the side walls and the elastic conductive assembly. In addition, the adhesive force between the diaphragm and the holder is increased, thereby improving the reliability of the speaker device.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF EMBODIMENTS

The technical solutions in the embodiments of the present disclosure are clearly and completely described below with reference to the drawings in the embodiments of the present disclosure. Apparently, the embodiments described are a part, rather than all of the embodiments of the present disclosure. All other embodiments obtained by those of ordinary skill in the art based on the embodiments in the present disclosure without creative efforts should fall within the protection scope of the present disclosure.

Figure 1:
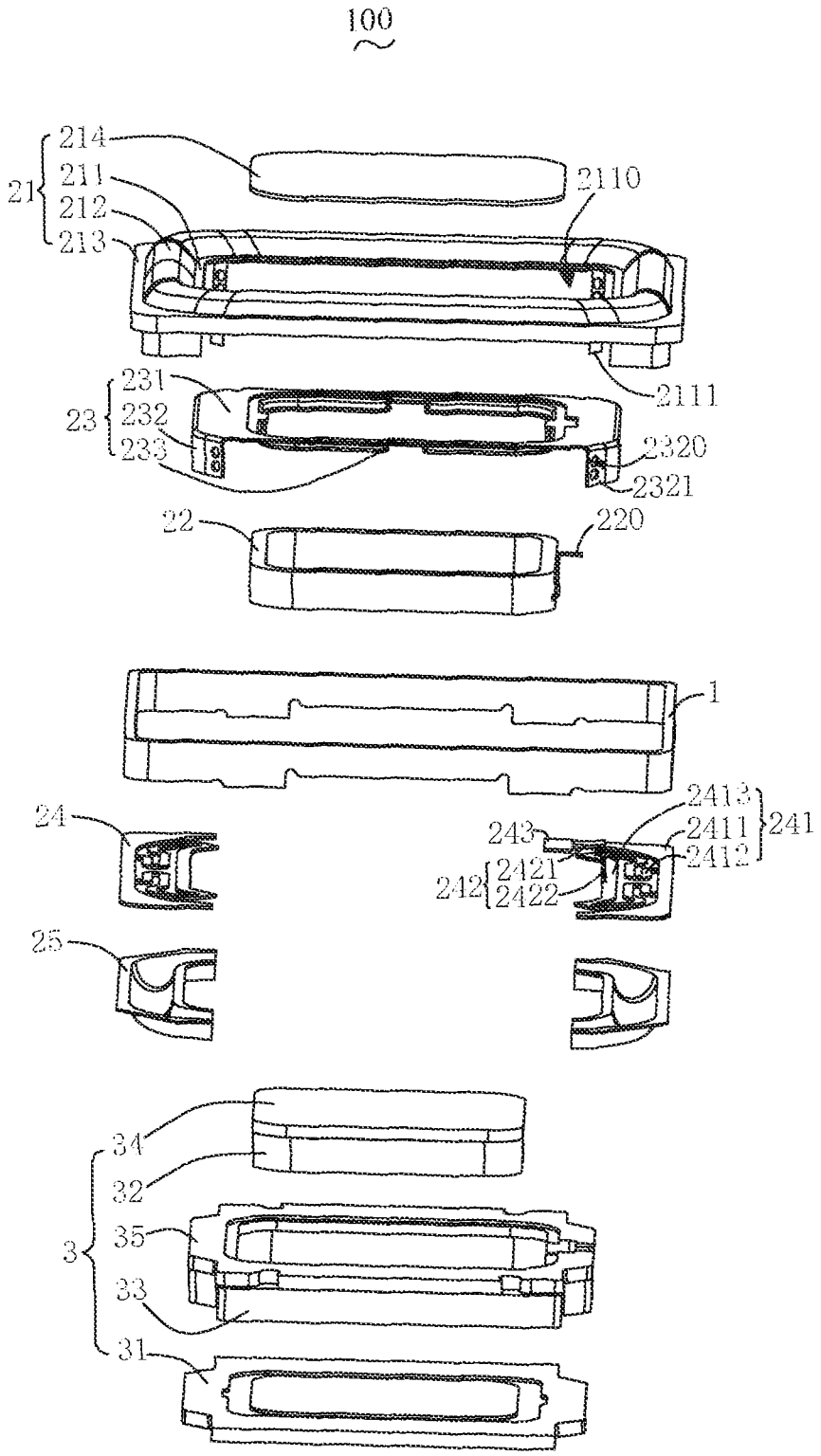
FIG. 1 is an exploded view illustrating a structure of a speaker device according to the present disclosure.
Figure 2:
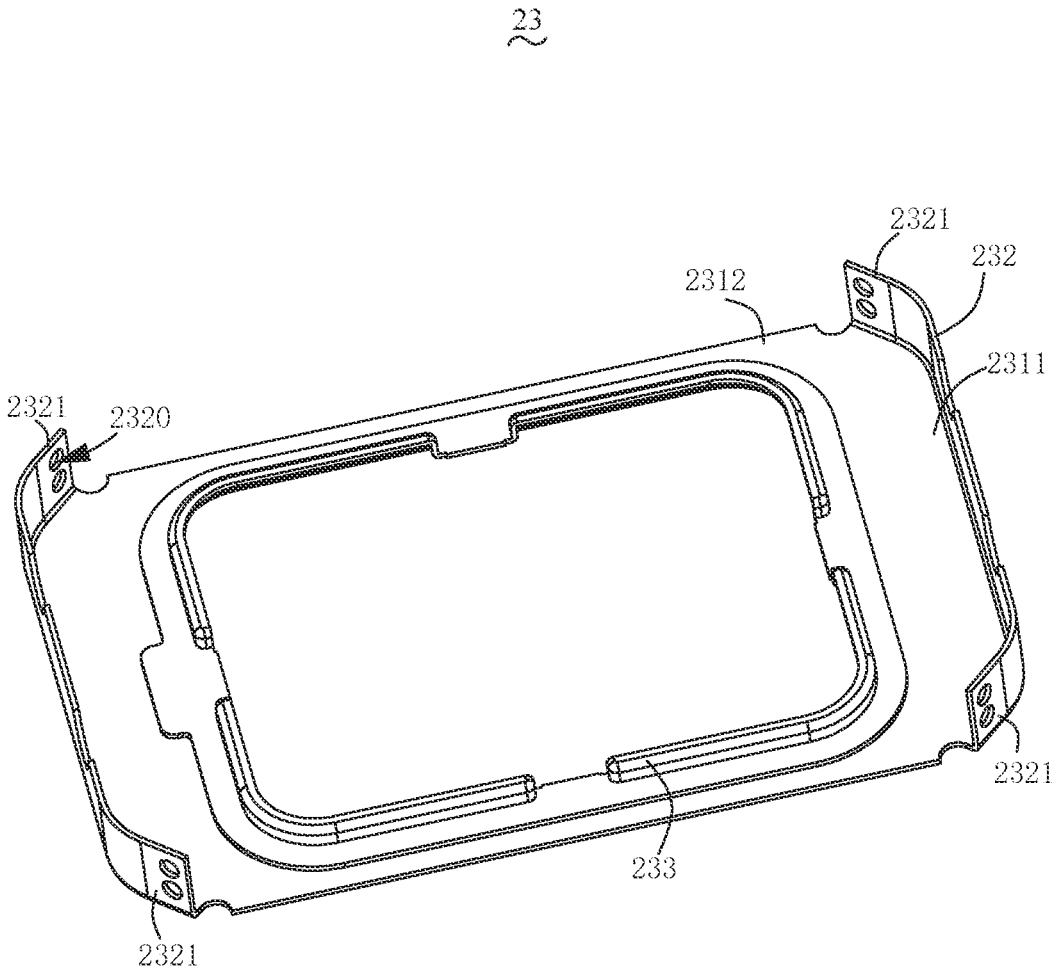
FIG. 2 is a view illustrating a structure of a holder of the speaker device according to the present disclosure.
Figure 3:
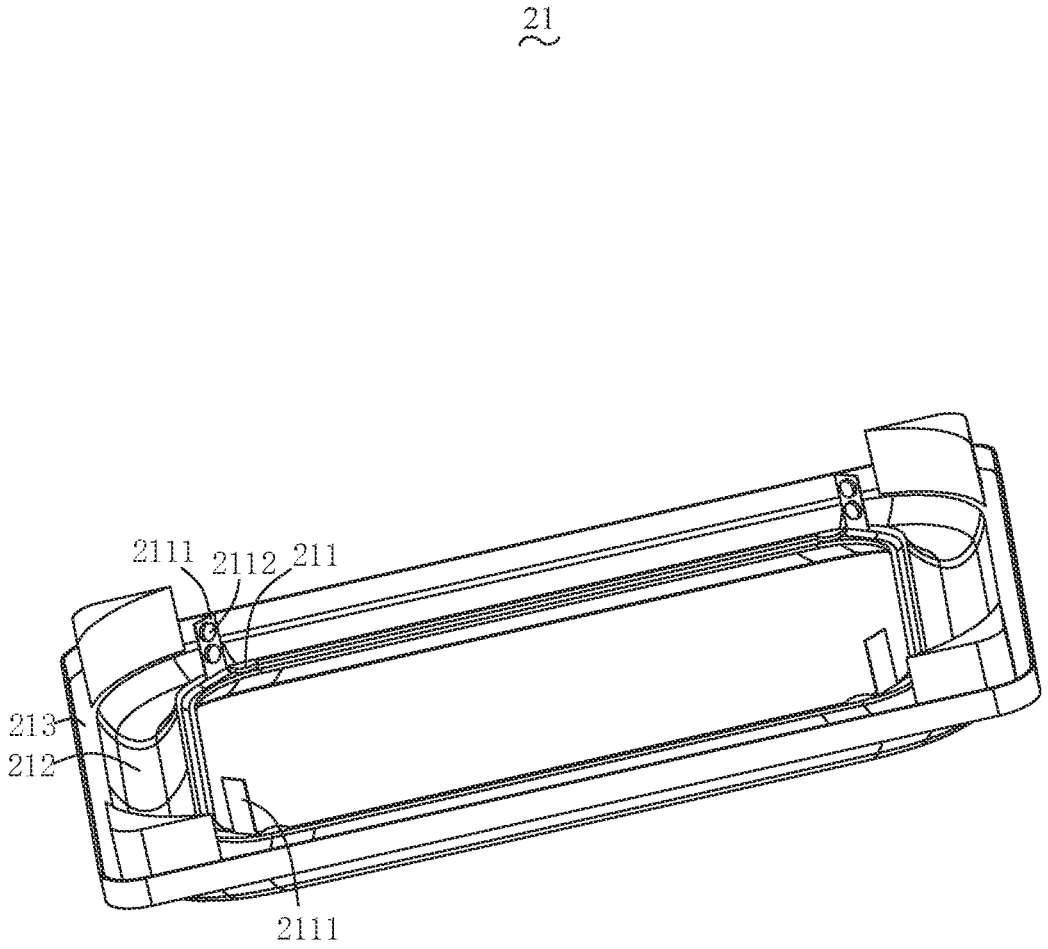
FIG. 3 is a view illustrating a structure of a diaphragm of the speaker device according to the present disclosure.
Figure 4:
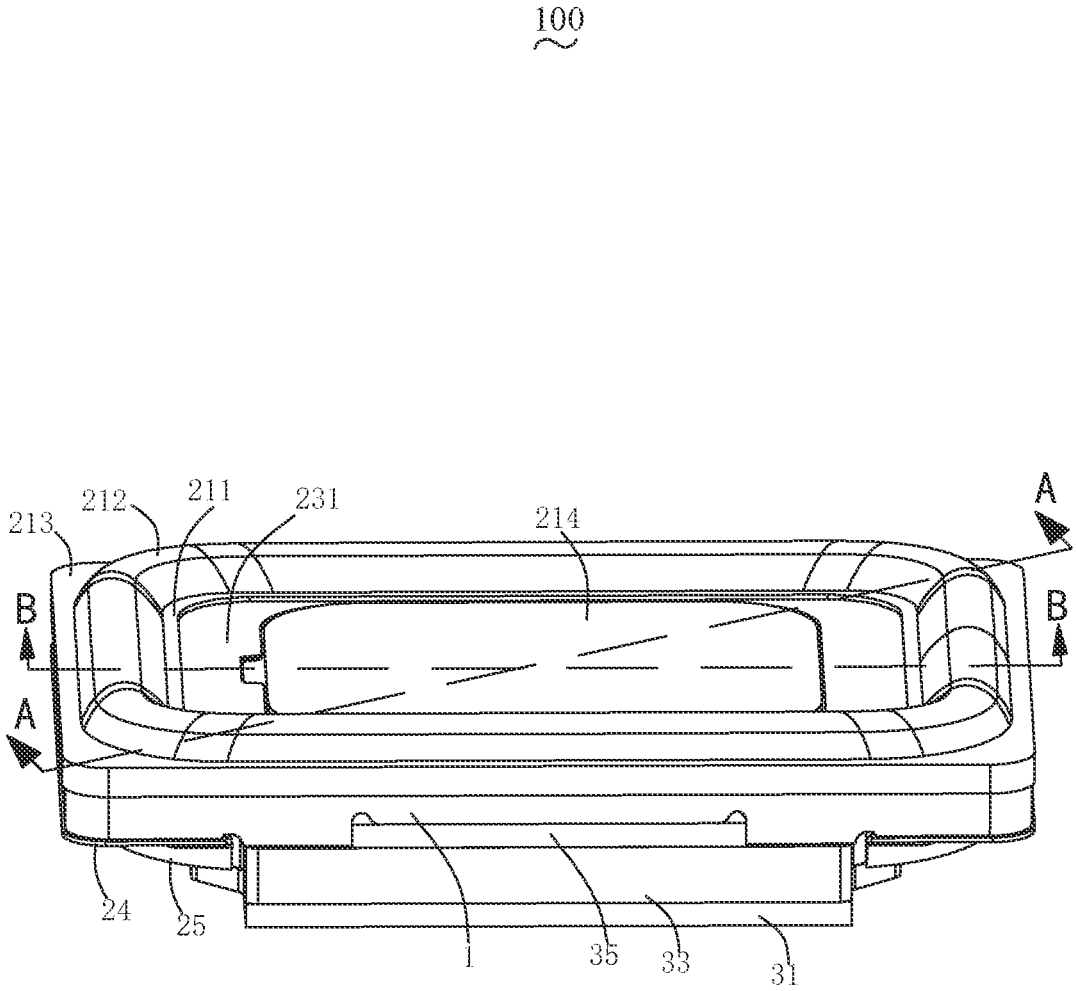
FIG. 4 is a three-dimensional view illustrating a structure of the speaker device according to the present disclosure.
Figure 5:
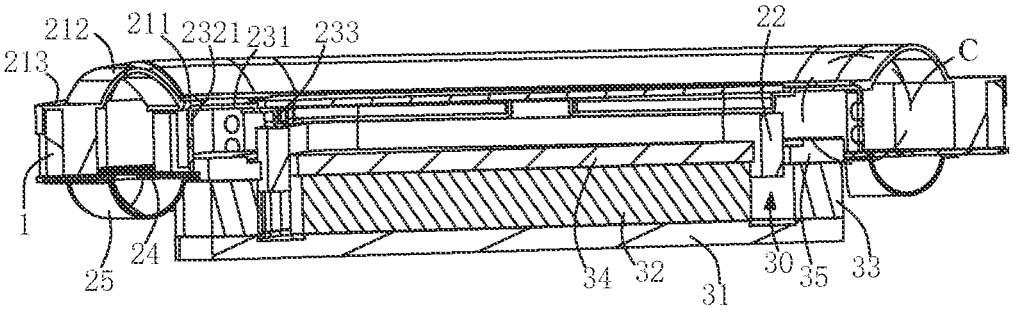
FIG. 5 is a sectional view taken along line A-A in FIG. 4.
Figure 6:
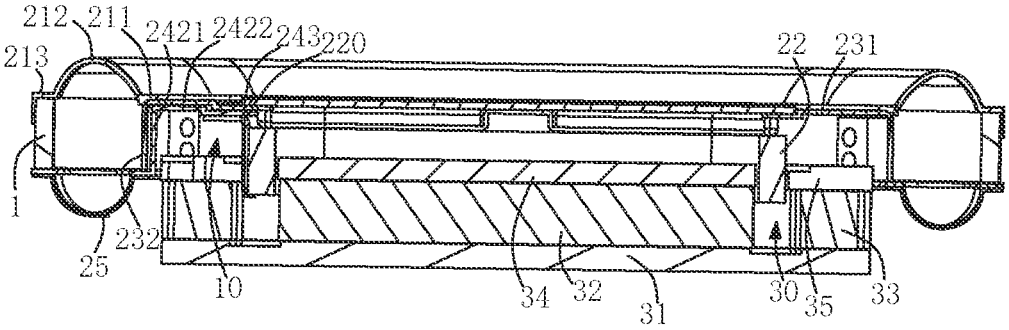
FIG. 6 is a sectional view taken along line B-B in FIG. 4.
Figure 7:
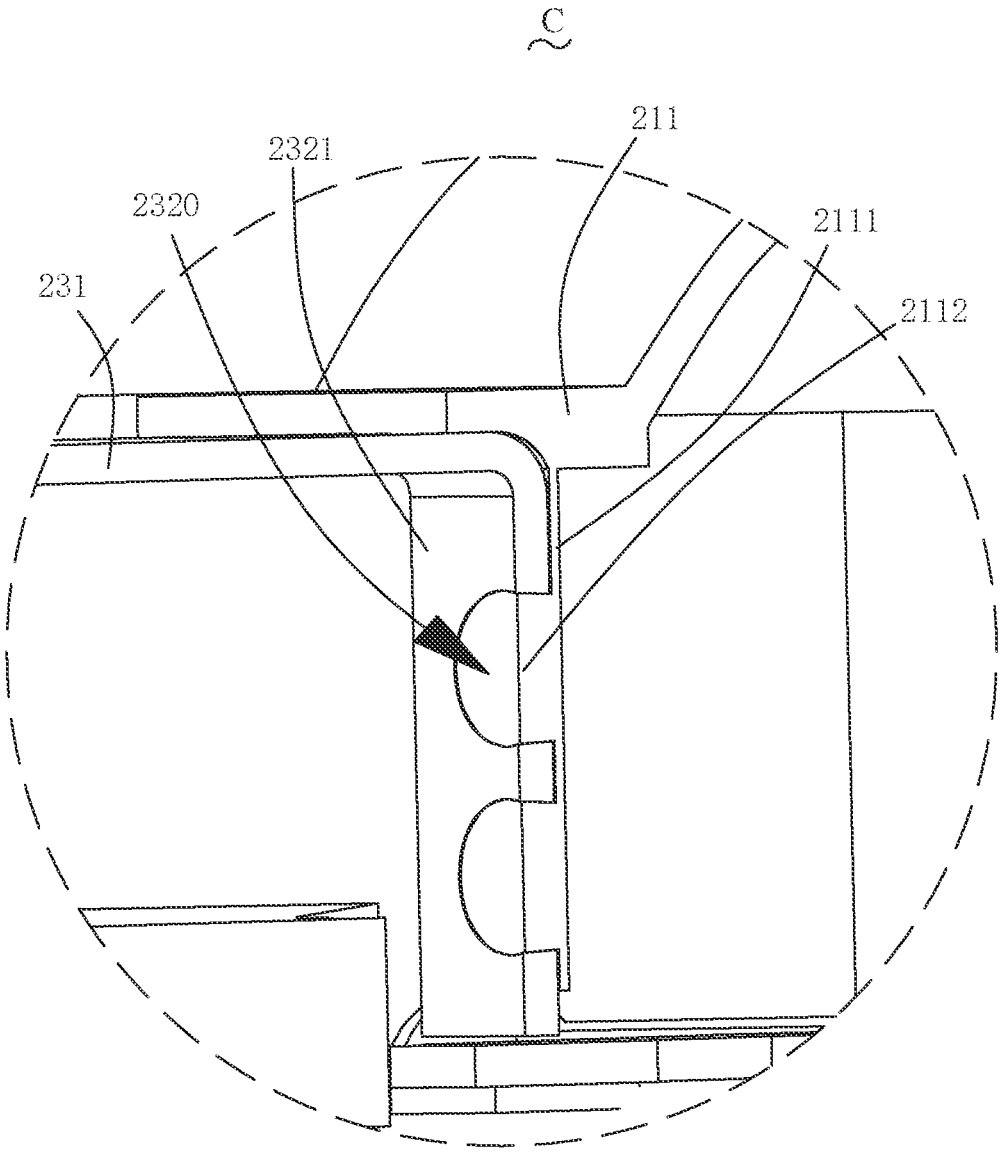
FIG. 7 is an enlarged view of C in FIG. 5.
Figure 8:
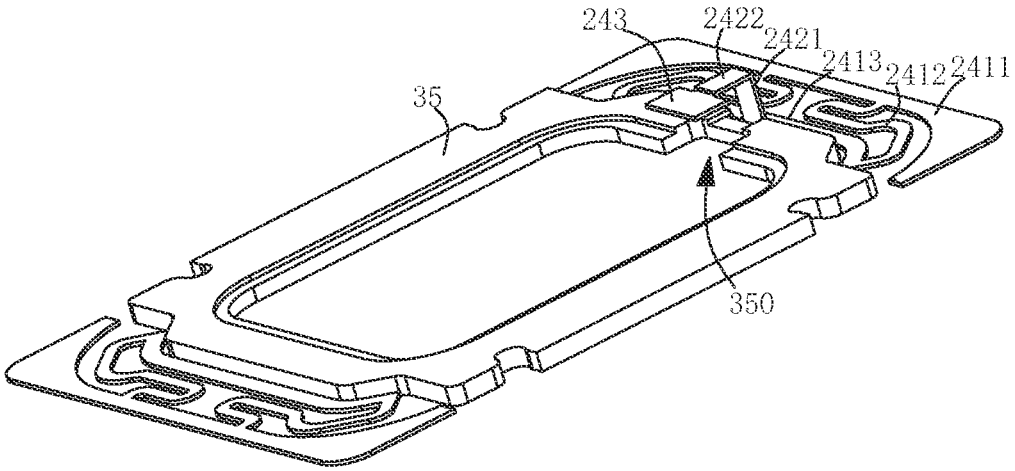
FIG. 8 is a view of a second magnetic conductor and elastic conductive assembly of the speaker device after assembly according to the present disclosure.

Referring to FIGS. 1 to 8, the present disclosure provides a speaker device 100. The speaker device 100 includes a frame 1, a vibration unit fixed to the frame 1 and a magnetic circuit unit 3 fixed to the frame 1 and driving the vibration unit to vibrate and produce sound. The magnetic circuit unit 3 is provided with a magnetic gap 30.

Specifically, the vibration unit includes a diaphragm 21 fixed to the frame 1, a holder 23 connected to the diaphragm 21, a voice coil 22 inserted into the magnetic gap 30 and connected to the holder 23, an elastic conductive assembly 24 fixed to the frame 1 and connected to a side of the holder 23 away from the diaphragm 21, and an auxiliary diaphragm 25 fixed to a side of the elastic conductive assembly 24 away from the diaphragm 21. The holder 23 and the voice coil 22 define an accommodating space 10.

The holder 23 includes a ring-shaped bottom wall 231 fixed to the diaphragm 21, a side wall 232 bending and extending from an outer periphery of the bottom wall 231 to the magnetic circuit unit 3 and a connecting portion 233 bending and extending from an inner periphery of the bottom wall 231 to the magnetic circuit unit 3. The bottom wall 231 includes a pair of short edges 2311 and a pair of long edges 2312. The side wall 232 is formed by bending and extending from an outer periphery of one of the pair of short edges 2311 to the magnetic circuit unit 3.

Specifically, there are two side walls 232 that are opposite and spaced apart from each other. Each of the side walls 232 is provided with an opening portion 2321 on a side close to the long edge 2312. The opening portion 2321 is provided with a first through hole 2320. An End of one of the side wall 232 away from the diaphragm 21 is connected to the elastic conductive assembly 24. The connecting portion 233 is connected to an end of the voice coil 22 toward the diaphragm 21.

The side wall 232 is spaced apart from the voice coil 22. The bottom wall 231, the side wall 232, the connecting portion 233 and the voice coil 22 define the accommodating space 10.

The diaphragm 21 includes a vibrating portion 211 provided with a second through hole 2110, a suspension portion 212 extending from a periphery of the vibrating portion 211 and surrounding the vibrating portion 211, a fixing portion 213 bending and extending from a side of the suspension portion 212 away from the vibrating portion 211 and fixed to the frame 1, and a dome 214 located in the second through hole 2110. The vibrating portion 211 surrounds and is spaced apart from the dome 214. The bottom wall 231 connects the vibrating portion 211 and the dome 214 into an integral structure, which is highly reliable.

Specifically, the vibrating portion 211 is fixed to and connected to the bottom wall 231. The vibrating portion 211 further includes a gluing member 2111 that is provided at a position corresponding to the opening portion 2321 and bends and extends to the magnetic circuit unit 3. The gluing member 2111 is arranged and fitted outside the opening portion 2321. The gluing member 2111 is provided with a fixing post 2112 that is located at a position corresponding to the first through hole 2320 and extends into the first through hole 2320. The gluing member 2111 is fixed to and connected to the opening portion 2321. The fixing post 2112 is accommodated in the first through hole 2320. During the molding of the diaphragm, the material of the diaphragm underflows along the opening portion 2321 to form the gluing member 2111, and the material flows into the first through hole 2320 to form the fixing post 2112. The design of the opening portion 2321 and the gluing member 2111 effectively solves the problem of material underflow during the molding of the diaphragm 21 of the speaker device 100. In this way, the connection part between the side wall 232 and the elastic conductive assembly 24 are prevented from being contaminated, thereby reducing the risk of unstable gluing between the side wall 232 and the elastic conductive assembly 24. In addition, the adhesive force between the diaphragm 21 and the holder 23 is increased, thereby improving the reliability of the speaker device 100.

One end of the frame 1 is fixed to the fixing portion 213, and the other end thereof is connected to the elastic conductive assembly 24.

The voice coil 22 is racetrack-shaped and is provided with two lead wires 220.

There are two elastic conductive assemblies 24. The elastic conductive assembly 24 each include an elastic conductive body 241 fixed to the frame 1 and connected to an end of a side wall 232 away from the diaphragm 21, a connecting arm 242 bending and extending from the elastic conductive body 241 to the accommodating space 10 along the holder 23 and a pad 243 connected to the connecting arm 242. The lead wire 220 is fixedly electrically connected to a side of the pad 243 away from the diaphragm 21.

Specifically, the elastic conductive body 241 includes a first body portion 2411 fixed to a side of the frame 1 away from the diaphragm 21, a second body portion 2413 fixed to an end of the side wall 232 away from the diaphragm 21 and two elastic arms 2412 connecting the first body portion 2411 and the second body portion 2413.

The connecting arm 242 includes a first connecting arm 2421 that bends and extends from a middle part of the second body portion 2413 to the bottom wall 231 along the side wall 232 and is located in the accommodating space 10 and a second connecting arm 2422 that bends and extends from the first connecting arm 2421 to the voice coil 22 along the bottom wall 231. The pad 243 is connected to the second connecting arm 2422.

The first connecting arm 2421 and the side wall 232 are spaced apart in parallel. The second connecting arm 2422 and the pad 243 are attached to a side of the bottom wall 231 toward the voice coil 22.

There are two auxiliary diaphragms 25, each of which is attached to a side of the elastic conductive assembly 24 away from the diaphragm 21.

The magnetic circuit unit 3 includes a yoke 31, a main magnet 32 fixed to the yoke 31, a peripheral magnet 33 surrounding the main magnet 32 and spaced apart from the main magnet 32 to form the magnetic gap 30, a first magnetic conductor 34 fixedly covering the main magnet 32 and a second magnetic conductor 35 fixedly covering the peripheral magnet 33. The second magnetic conductor 35 is fixed to and connected to the side of the frame 1 away from the diaphragm 21. The second magnetic conductor 35 is provided with an avoiding portion 350 at a position corresponding to the pad 243. When the speaker device vibrates and produces sound, the second magnetic conductor 35 will not collide with the pad 243, so as to avoid affecting the electrical connection between the pad 243 and the lead wire 220, thereby improving the safety of the speaker device.

Compared with the related art, in the present disclosure, the end of one of the pair of side walls of the holder is provided with the opening portion, and the opening portion is provided with the first through hole. During the molding of the diaphragm, the material flows into the first through hole along the opening portion. This design effectively solves the problem of material underflow during the molding of the diaphragm of the speaker device. In this way, the connection part between the side wall and the elastic conductive assembly is prevented from being contaminated, thereby reducing the risk of unstable gluing between the side wall and the elastic conductive assembly. In addition, the adhesive force between the diaphragm and the holder is increased, thereby improving the reliability of the speaker device.

The above described are merely embodiments of the present disclosure, which are not intended to limit the scope of the patent of the present disclosure. Any equivalent structure or process change made based on the specification and drawings of the present disclosure, or direct or indirect application thereof in other related technical fields, should fall within the protection scope of the patent of the present disclosure.

What is claimed is:

1. A speaker device, comprising a frame, a vibration unit fixed to the frame and a magnetic circuit unit fixed to the frame and driving the vibration unit to vibrate and produce sound, wherein the magnetic circuit unit is provided with a magnetic gap; and the vibration unit comprises a diaphragm fixed to the frame, a holder fixed to the diaphragm, and a voice coil inserted into the magnetic gap and connected to the holder; and the holder comprises a bottom wall fixed to the diaphragm and comprising a pair of long edges and a pair of short edges, and a pair of side walls each bending and extending from an outer periphery of a respective one of the pair of short edges of the bottom wall toward the magnetic circuit unit; each of the pair of side walls is provided with an opening portion at a side close to one of the pair of long edges; the opening portion is provided with a first through hole; and the diaphragm is connected to the opening portion and partially accommodated in the first through hole; wherein the bottom wall is ring-shaped; the holder further comprises a connecting portion bending and extending from an inner periphery of the bottom wall toward the magnetic circuit unit and the voice coil is fixed to and connected to the connecting portion.

2. The speaker device as described in claim 1, wherein the diaphragm comprises a vibrating portion provided with a second through hole, a suspension portion extending from an outer periphery of the vibrating portion and surrounding the vibrating portion, a fixing portion bending and extending from a side of the suspension portion away from the vibrating portion and fixed to the frame, and a dome located in the second through hole; and the bottom wall connects the vibrating portion and the dome.

3. The speaker device as described in claim 2, wherein the vibrating portion further comprises a gluing member that is provided at a position corresponding to the opening portion and bends and extends toward the magnetic circuit unit; the gluing member is provided with a fixing post that is located at a position corresponding to the first through hole and extends inward the first through hole; the gluing member is fixed to and connected to the opening portion; and the fixing post is accommodated in the first through hole.

4. The speaker device as described in claim 1, wherein the vibration unit further comprises an elastic conductive assembly fixed to the frame and an end of the holder away from the diaphragm;

the elastic conductive assembly comprises an elastic conductive body connected to the frame and an end of one of the pair of side walls away from the diaphragm, a connecting arm bending and extending from the elastic conductive body toward the voice coil along one of the pair of side walls, and a pad connected to the connecting arm; and the pad is fixed to and connected to a side of the bottom wall away from the diaphragm.

5. The speaker device as described in claim 4, wherein the connecting arm comprises a first bending portion bending and extending from the elastic conductive body toward the bottom wall, and a second bending portion bending and extending from the first bending portion toward the voice coil; the first bending portion and one of the pair of side walls are spaced apart in parallel; and the second bending portion and the pad are respectively connected to a side of the bottom wall away from the diaphragm.

6. The speaker device as described in claim 1, wherein the magnetic circuit unit comprises a yoke, a main magnet fixed to the yoke, a peripheral magnet surrounding the main magnet and spaced apart from the main magnet to form the magnetic gap, a first magnetic conductor fixed to and covering the main magnet, and a second magnetic conductor fixed to and covering the peripheral magnet; the second magnetic conductor is fixed to and connected to a side of the frame away from the diaphragm; and the second magnetic conductor is provided with an avoiding portion at a position corresponding to the pad.

* * * * *